US010815700B2

(12) United States Patent
Perkins

(10) Patent No.: US 10,815,700 B2
(45) Date of Patent: Oct. 27, 2020

(54) RELEASE ACTUATOR FOR LATCH

(71) Applicant: INTEVA PRODUCTS, LLC, Troy, MI (US)

(72) Inventor: Donald M. Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 552 days.

(21) Appl. No.: 15/392,101

(22) Filed: Dec. 28, 2016

(65) Prior Publication Data

US 2017/0191289 A1 Jul. 6, 2017

Related U.S. Application Data

(60) Provisional application No. 62/273,410, filed on Dec. 30, 2015.

(51) Int. Cl.

| | |
|---|---|
| ***E05B 81/14*** | (2014.01) |
| ***E05B 77/06*** | (2014.01) |
| ***E05B 77/04*** | (2014.01) |
| ***E05B 81/06*** | (2014.01) |
| ***E05B 81/16*** | (2014.01) |

(52) U.S. Cl.

CPC ..... *E05B 77/04* (2013.01); *E05B 77/06* (2013.01); *E05B 81/06* (2013.01); *E05B 81/14* (2013.01); *E05B 81/15* (2013.01); *E05B 81/16* (2013.01); *Y10S 292/73* (2013.01); *Y10T 292/1082* (2015.04)

(58) Field of Classification Search

CPC . Y10T 292/1082; Y10S 292/56; Y10S 292/73
See application file for complete search history.

(56) References Cited

U.S. PATENT DOCUMENTS

| | | | | |
|---|---|---|---|---|
| 4,854,617 A * | 8/1989 | Hayakawa | E05B 77/40 | 292/216 |
| 5,020,838 A * | 6/1991 | Fukumoto | E05B 81/14 | 292/201 |
| 5,938,253 A * | 8/1999 | Szablewski | E05B 81/14 | 292/216 |
| 6,109,671 A * | 8/2000 | Roncin | E05B 81/14 | 292/201 |
| 6,155,124 A * | 12/2000 | Wirths | E05B 81/14 | 292/201 |
| 6,386,599 B1 * | 5/2002 | Chevalier | E05B 81/14 | 292/201 |

(Continued)

*Primary Examiner* — Carlos Lugo
(74) *Attorney, Agent, or Firm* — Cantor Colburn LLP

(57) ABSTRACT

A vehicle latch having: a frame; a pawl rotatably mounted to the frame for movement between an engaged position and a disengaged position; a claw rotatably mounted to the frame for movement between a latched position and an open position, wherein pawl is configured to impede rotational movement of the claw from the latched position to the open position when the pawl is in the engaged position; a release lever rotatably mounted to the frame; and a worm wheel having a plurality of cam lobes, wherein each of the cam lobes are located in separate and distinct planes with respect to each other, wherein the release lever operably couples the pawl to the worm wheel such that rotational movement of the worm wheel rotates the pawl.

16 Claims, 9 Drawing Sheets

(56) References Cited

U.S. PATENT DOCUMENTS

| | | | | |
|---|---|---|---|---|
| 6,575,507 | B2 * | 6/2003 | Reddmann | E05B 81/14 292/201 |
| 6,698,300 | B2 * | 3/2004 | Swan | E05B 81/25 292/201 |
| 6,712,407 | B2 * | 3/2004 | Duriez | E05B 81/14 292/201 |
| 7,090,264 | B2 * | 8/2006 | Dzurko | E05B 85/243 292/201 |
| 7,467,815 | B2 * | 12/2008 | Larsen | E05B 81/14 292/201 |
| 7,815,230 | B2 * | 10/2010 | Yoshikuwa | E05B 81/25 292/201 |
| 8,328,249 | B2 * | 12/2012 | Corrales | E05B 81/14 292/201 |
| 9,435,145 | B2 * | 9/2016 | Lujan | E05B 77/36 |
| 9,617,761 | B2 * | 4/2017 | Scholz | E05B 81/14 |
| 9,915,082 | B2 * | 3/2018 | Garneau | E05B 47/0012 |
| 10,000,949 | B2 * | 6/2018 | Vazquez | E05B 83/18 |
| 2003/0006618 | A1 * | 1/2003 | Kalsi | E05B 81/06 292/201 |
| 2011/0031765 | A1 * | 2/2011 | Vazquez | E05B 85/26 292/217 |
| 2012/0175896 | A1 * | 7/2012 | Martinez | E05B 81/06 292/199 |

* cited by examiner

RELEASE ACTUATOR FOR LATCH

CROSS REFERENCE TO RELATED APPLICATIONS

This application claims the benefit of U.S. Provisional Patent Application No. 62/273,410 filed on Dec. 30, 2016, the entire contents of which are incorporated herein by reference thereto.

BACKGROUND

This invention relates to a release actuator for a latch. More particularly, the present invention relates to an electric release actuator for a vehicle latch. In one embodiment, the latch may be used with a vehicle lift gate.

Currently, there has been a desire to manufacture latching systems in smaller packaging with a lower mass, while providing improved performance under a variety of conditions. End gate or rear door latch systems offer unique challenges to such desires.

In the case of a rear door latch, the packaging space is at a premium and thus the latch can be exposed to excessive inertia events in unique directions, which differ from those of a side door. The pawl/claw geometry often employed in lift gate latches with a power release incorporates an extended lever or encapsulation on the pawl lever that is acted upon by the release actuator (pawl-release lever). This one piece lever is rotated to an open position and often held in this position by a "memory" lever (also referred to as a hold-open lever, or snow load lever). Once held at this position, the release actuator will continue rotation and stop against the pawl release lever thus stalling the motor.

An extended pawl release lever transfers the center of gravity of the pawl further away from its pivot thus creating a large opening torque when exposed to inertia events. To counteract this effect or prevent rotation of the pawl during these inertia events, a larger pawl return spring must be implemented, thus creating a larger area for the latch and thus packaging concerns as well as higher release efforts in order to overcome the larger spring. The higher release efforts require more energy from the actuator to complete the release event, or a longer moment arm that will require additional travel.

In addition, a memory lever is an additional component that may require an additional return spring to function correctly. Furthermore, an extended pawl release lever, coupled with a higher torque return spring, will need to cycle 100% of the time with the pawl thereby creating a potential source of sound generation, which is also undesirable.

Accordingly, it is desirable to provide an improved release actuator for a latch.

SUMMARY OF THE INVENTION

In one embodiment, a vehicle latch is provided. The vehicle latch having: a frame; a pawl rotatably mounted to the frame for movement between an engaged position and a disengaged position; a claw rotatably mounted to the frame for movement between a latched position and an open position, wherein pawl is configured to impede rotational movement of the claw from the latched position to the open position when the pawl is in the engaged position; a release lever rotatably mounted to the frame; and a worm wheel having a plurality of cam lobes, wherein each of the cam lobes are located in separate and distinct planes with respect to each other, wherein the release lever operably couples the pawl to the worm wheel such that rotational movement of the worm wheel rotates the pawl.

In addition to one or more features described above, or as an alternative to any of the foregoing embodiments, the plurality of cam lobes may act as driving surfaces to release the pawl from engagement with the claw.

In addition to one or more features described above, or as an alternative to any of the foregoing embodiments, one of the plurality of cam lobes may be a stop feature that is configured to contact the release lever of the latch.

In addition to one or more features described above, or as an alternative to any of the foregoing embodiments, the release lever may be spring biased into a rest position by a spring.

In addition to one or more features described above, or as an alternative to any of the foregoing embodiments, further embodiments may include a motor assembly for rotating the worm wheel.

In addition to one or more features described above, or as an alternative to any of the foregoing embodiments, the release lever may include cam surfaces that interface with the cam lobes of the worm wheel.

In addition to one or more features described above, or as an alternative to any of the foregoing embodiments, the release lever may include a stop surface the interfaces with the stop feature of the worm wheel.

In addition to one or more features described above, or as an alternative to any of the foregoing embodiments, the spring may be located about a rotation axis of the release lever.

In addition to one or more features described above, or as an alternative to any of the foregoing embodiments, a center of gravity (CG) of the pawl and a center of gravity (CG) of the release lever may provide a system that is significantly more robust to external acceleration events than a latch with a pawl directly coupled to the worm wheel.

In addition to one or more features described above, or as an alternative to any of the foregoing embodiments, the center of gravity (CG) of the pawl and the center of gravity (CG) of the release lever allow for a smaller return spring to be used with pawl.

In addition to one or more features described above, or as an alternative to any of the foregoing embodiments, further embodiments may include a memory lever integrated into a housing of the latch.

In addition to one or more features described above, or as an alternative to any of the foregoing embodiments, the memory lever may have a feature configured to engage an integral engagement feature of the release lever.

In addition to one or more features described above, or as an alternative to any of the foregoing embodiments, the memory lever may have an integral ramp feature that slides up on an engagement feature of the release lever.

In addition to one or more features described above, or as an alternative to any of the foregoing embodiments, the claw may have an integral ramp that engages a ramp of the memory lever.

In yet another embodiment, an actuator for a vehicle latch is provided. The actuator having: a motor assembly for rotating a worm wheel, the worm wheel having a plurality of cam lobes, wherein each of the cam lobes are located in separate and distinct planes with respect to each other; and a release lever rotatably mounted to a frame of the latch, wherein rotation of the worm wheel causes movement of the release lever.

In addition to one or more features described above, or as an alternative to any of the foregoing embodiments, two of the plurality of cam lobes may act as driving surfaces to release a pawl from engagement with a claw of the latch.

In addition to one or more features described above, or as an alternative to any of the foregoing embodiments, one of the plurality of cam lobes may be a stop feature that is configured to contact the release lever of the latch, wherein the release lever is operatively coupled to the pawl.

In addition to one or more features described above, or as an alternative to any of the foregoing embodiments, further embodiments include a memory lever integrated into a housing of the latch.

In addition to one or more features described above, or as an alternative to any of the foregoing embodiments, the memory lever may have a feature configured to engage an integral engagement feature of the release lever.

In yet another embodiment, a method of actuating a pawl of a vehicle latch is provided. The method including the steps of: pivotally mounting the pawl to a frame of the latch, wherein the pawl is configured to prevent a claw of the latch from moving into an open position when the pawl is in an engaged position with respect to the claw; operably coupling a release lever to the pawl and a plurality of cam lobes of a worm wheel, wherein each of the cam lobes are located in separate and distinct planes with respect to each other and wherein the release lever is pivotally mounted to the frame of the latch; and wherein a center of gravity (CG) of the pawl and a center of gravity (CG) of the release lever provide a system that is significantly more robust to external acceleration events than a latch with a single pawl directly coupled to the worm wheel and the claw.

BRIEF DESCRIPTION OF THE DRAWINGS

Other features, advantages and details appear, by way of example only, in the following description of embodiments, the description referring to the drawings in which.

Figure 1:
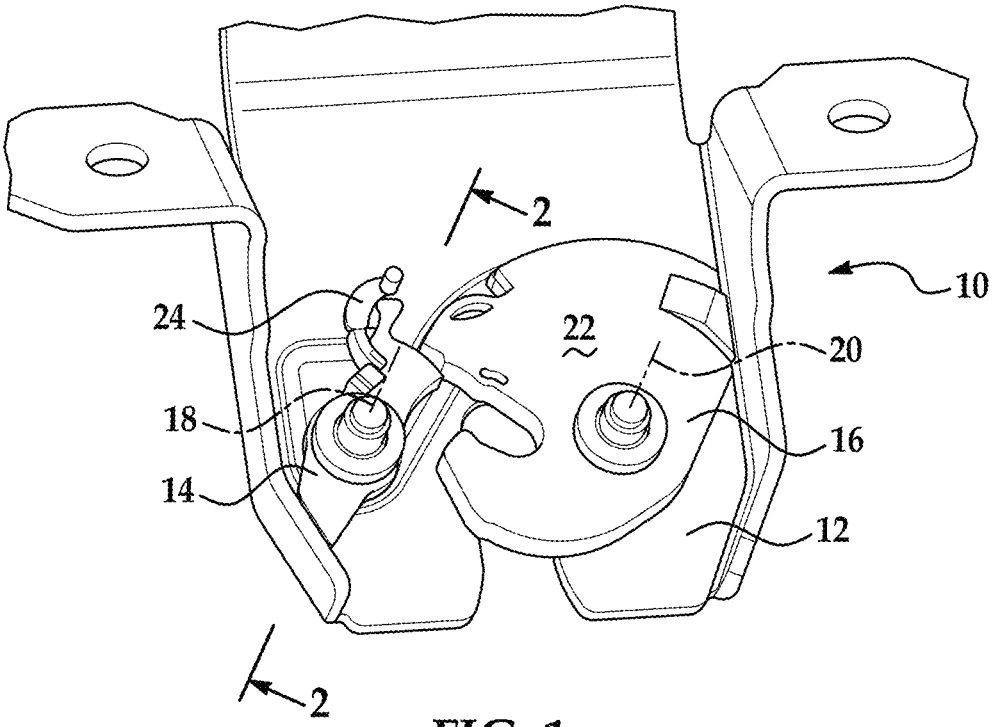
FIG. 1 is a perspective view of portions of a latch in accordance with an embodiment of the present invention.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Turning now to the drawings, wherein to the extent possible like reference numerals are utilized to designate like components throughout the various views and as described herein, a release actuator and latch having a release actuator is disclosed herein.

As will be described herein, an efficient, cost effective, low mass design is provided wherein the actuator and/or latch will meet the intended requirements while keeping the number of components to a minimum thereby easing manufacturing requirements.

Referring now to FIG. 1, portions of a latch 10 in accordance with an embodiment of the present invention is illustrated. In one embodiment, the latch 10 may be a vehicle latch or a rear door latch. Latch 10 has a frame 12, a pawl 14 and a claw 16. The pawl 14 and claw 16 are each rotatably or pivotally mounted to the frame 12 of the latch 10 for movement about an axis 18, 20 respectively. As is known in the related arts, the claw 16 is configured to release and retain a striker as it moves between an open position and a latched position. In addition, the pawl or detent lever 14 is configured to move between an engaged position, wherein a portion of the pawl or detent lever 14 contacts the claw 16 and prevents its movement from the latched position to the open position and a disengaged position wherein the portion of the pawl or detent lever 14 no longer contacts the claw 16 and thus allows its movement from the latched position to the open position.

Figure 2:
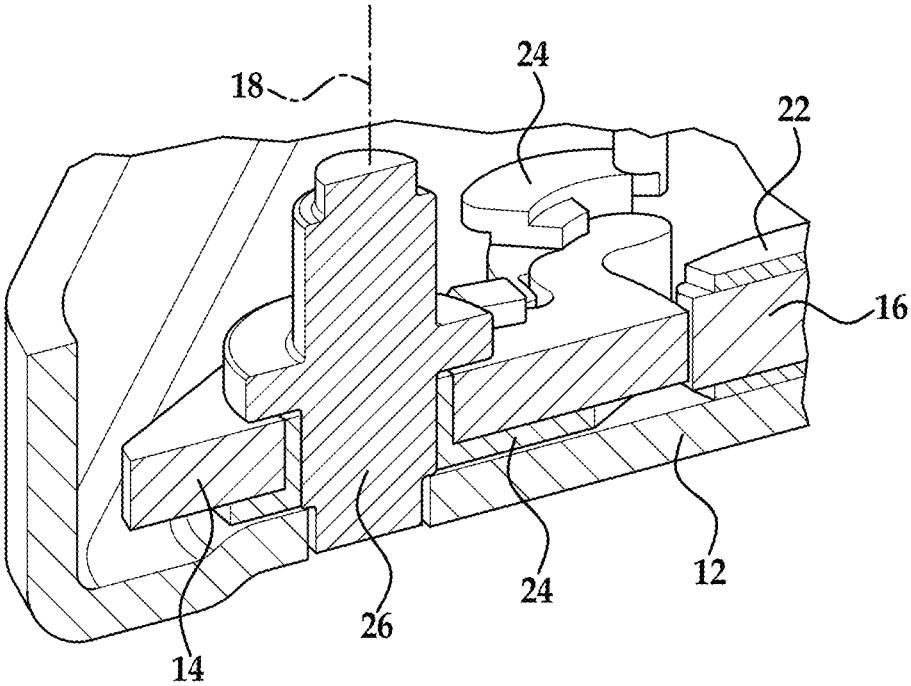
FIG. 2 is a cross section view along lines 2-2 of FIG. 1.

In one embodiment, the claw 16 may be overmolded or encapsulated with a thermoplastic elastomer over mold 22 that to provides friction and sound abatement. Also shown is an assembled clip 24 that provides isolation between the pawl 14, the frame 12 and a pawl pivot pin 26 as illustrated in at least FIG. 2.

Figure 3:
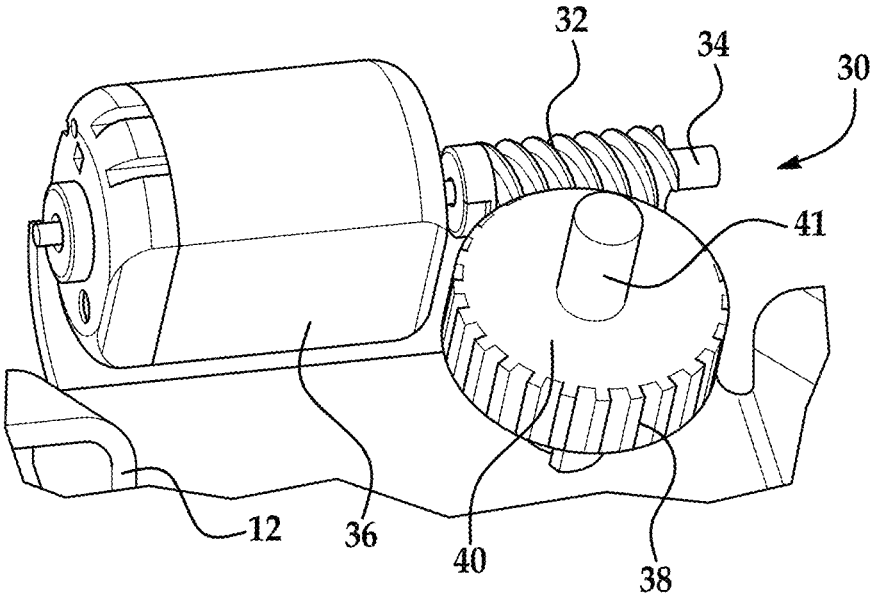
FIG. 3 illustrates a motor assembly of the latch.

FIG. 3 illustrates a motor assembly 30 for use with latch 10. Motor assembly may comprise a portion of an actuator 50 that is configured to electrically operate the latch. Motor assembly 30 has a worm gear 32 assembled to a shaft 34 of a release motor 36 that is configured to meshingly engage a plurality of teeth 38 of a worm wheel 40. Worm wheel 40 pivots about a shaft 41 that is secured to frame 12.

Figure 4:
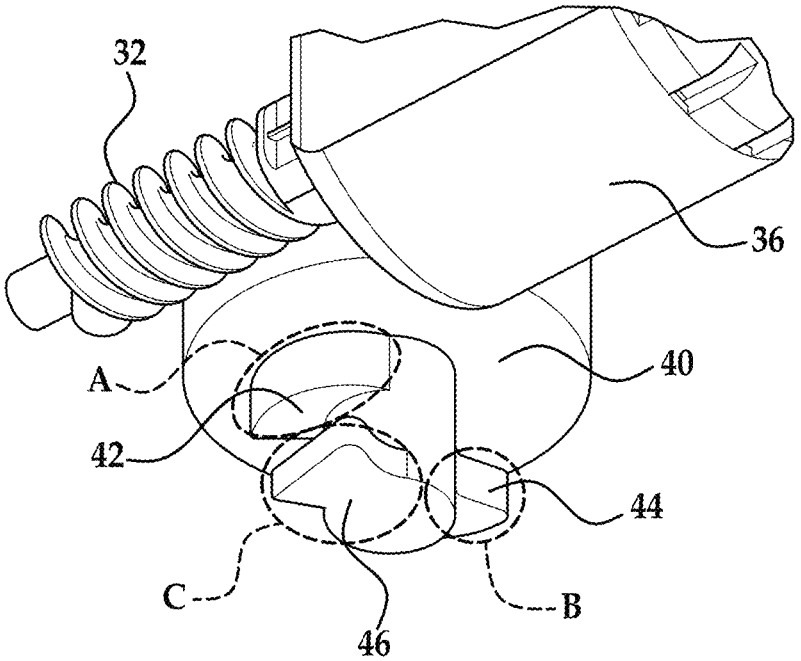
FIG. 4 illustrates a bottom view of the motor and worm wheel.

FIG. 4 illustrates a bottom view of the motor 36 and worm wheel 40. As illustrated, worm wheel 40 has a plurality of cam lobes 42, 44 and 46 integrated into the worm wheel 40. In one embodiment and as illustrated each of the cam lobes 42, 44 and 46 are located in separate and distinct planes (A, B and C) with respect to each other. In one embodiment, the cam lobes 42 and 44 act as driving surfaces to release the pawl 14 by contacting a release lever 48 operably coupled to the worm wheel 40 and the pawl 14. Also integrated into the worm wheel is a stop feature (lobe 46) that is configured to contact the release lever 48 and stall the actuator 50 of the latch 10.

Figure 5:
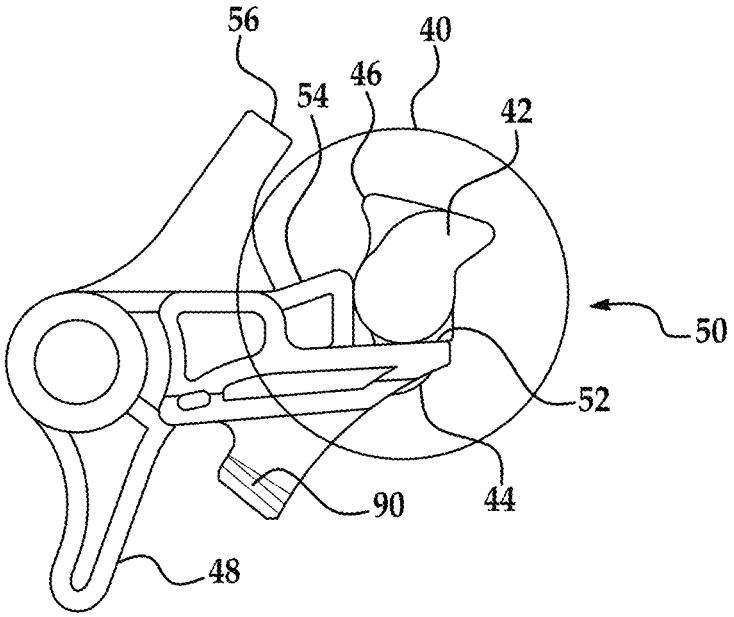
FIG. 5 illustrates the worm wheel in a neutral position.

FIG. 5 shows the worm wheel 40 in a neutral position, wherein the circular portion of the worm wheel portion is represented by a circle to improve clarity. Also shown is the relative position of the release lever 48 at its rest position. Also depicted are cam surfaces 52, 54 on the release lever 48 that interface with the associated cam lobes 42, 44 of the worm wheel 40, and a stop surface 56 on the release lever 48 that is associated or interfaces with the stop feature 46 of the worm wheel 40.

Figure 6:
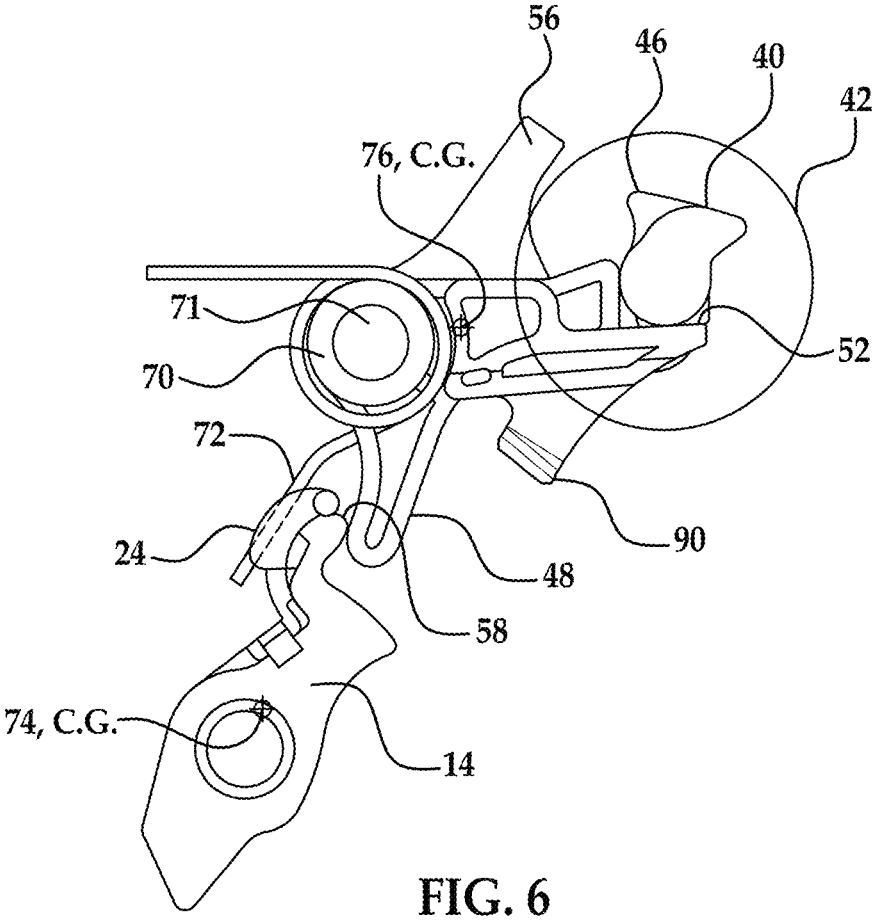
FIG. 6 illustrates the interface between the release lever contact feature and the pawl.

FIG. 6 shows the interface between a contact feature 58 of the release lever 48 and a portion of the pawl 14. Also illustrated is a multifunction return spring 70 that is located about the rotational axis 71 of the release lever 48 and the geometry of its contact leg 72 with the pawl isolation clip 24. It should be noted that by implementing the additional release lever geometry described and illustrated herein the center of gravity (CG) 74 of the pawl 14 and the center of gravity (CG) 76 of the release lever 48 allow for a system that is significantly more robust to external acceleration events over a conventional one piece pawl and lever geometry. For example, and by configuring the latch 10 to have the CGs 74 and 76 as located, the required acceleration of G-forces that would have to be applied to latch 10 meet desired requirements without having to significantly increase the spring factor K of spring 70 such that a larger system and motor force would be required.

Accordingly, the return spring 70 needs only a minimal additional output to control extreme external acceleration forces as seen during crash and roll-over events. By maintaining an optimal spring torque, the release efforts can be minimized and the package size of the latch 10 and actuator 50 can be decreased, as the release actuator 50 will require lower energy to perform its intended function.

Figure 7A:
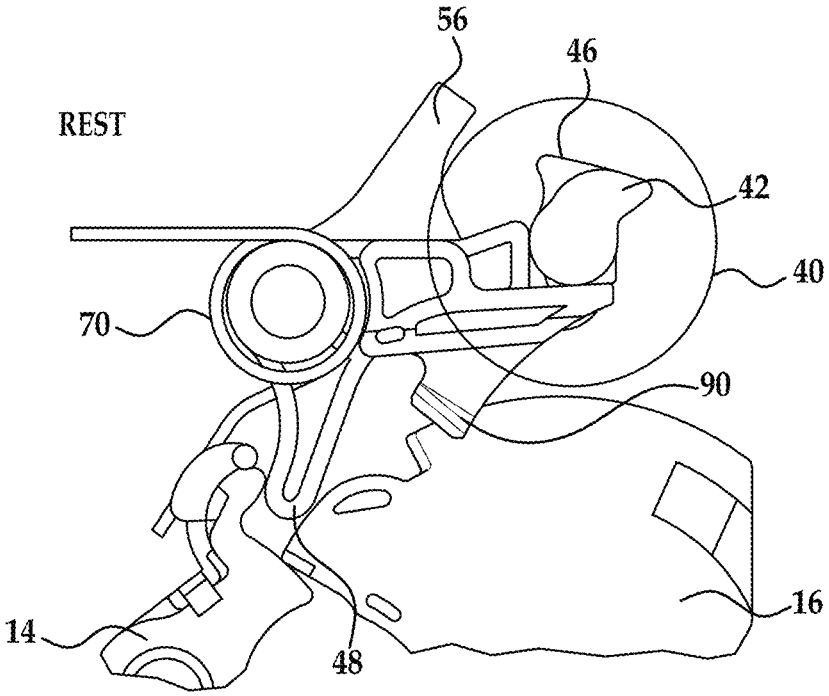
FIG. 7A illustrates the release mechanism in a rest position.
Figure 7B:
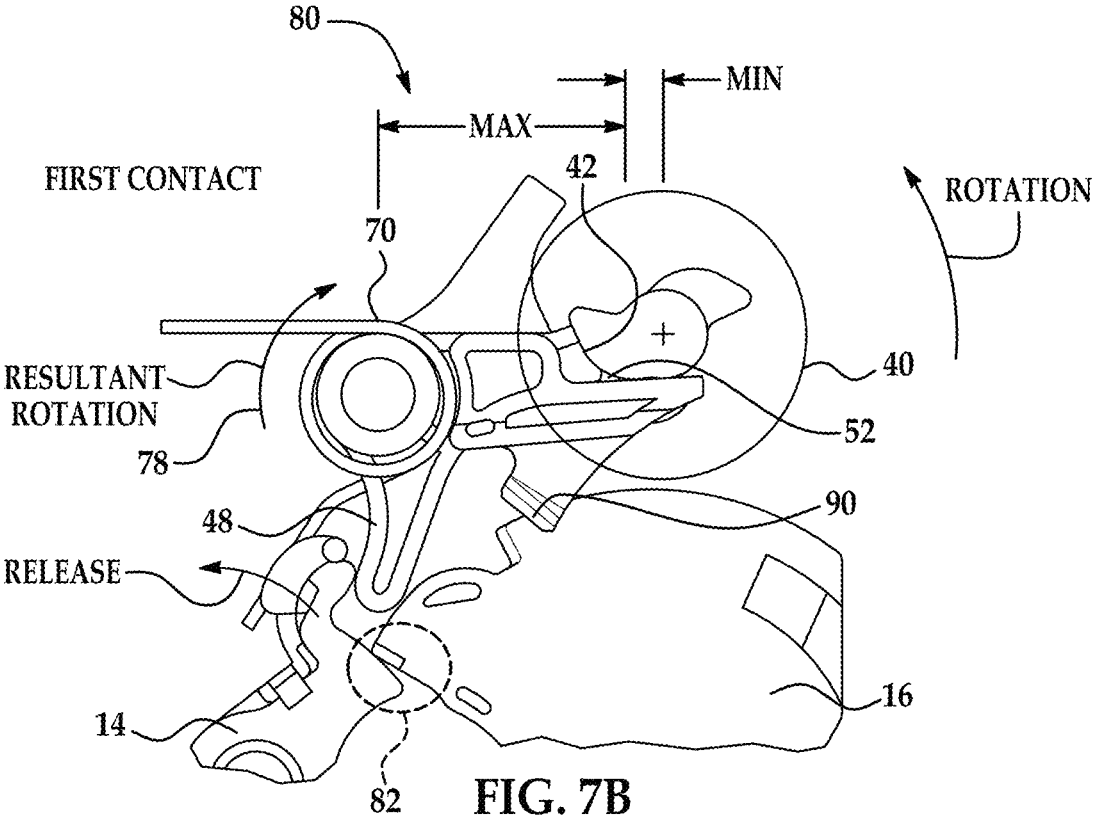
FIG. 7B illustrates the release mechanism in its first contact position.
Figure 7C:
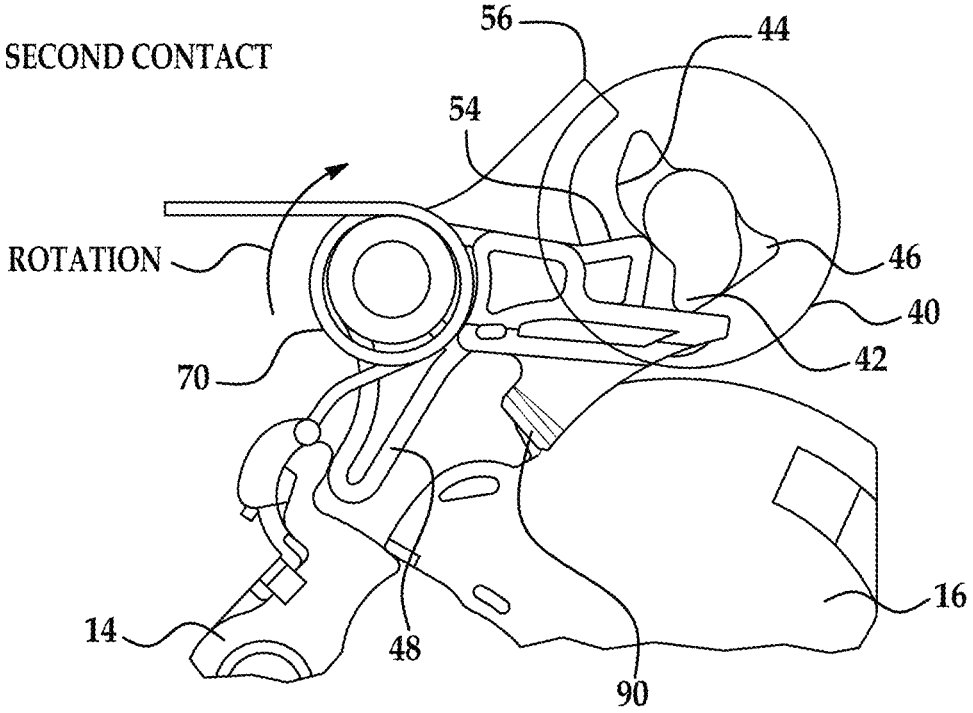
FIG. 7C illustrates the release mechanism in its second contact position.
Figure 7D:
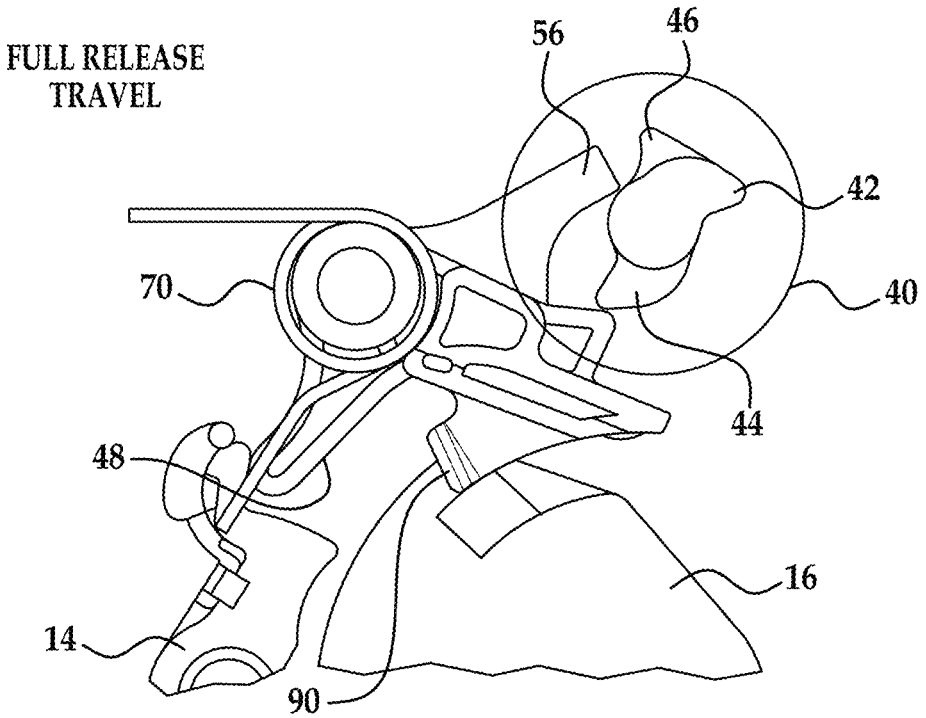
FIG. 7D illustrates the release mechanism in its full travel position.
Figure 7E:
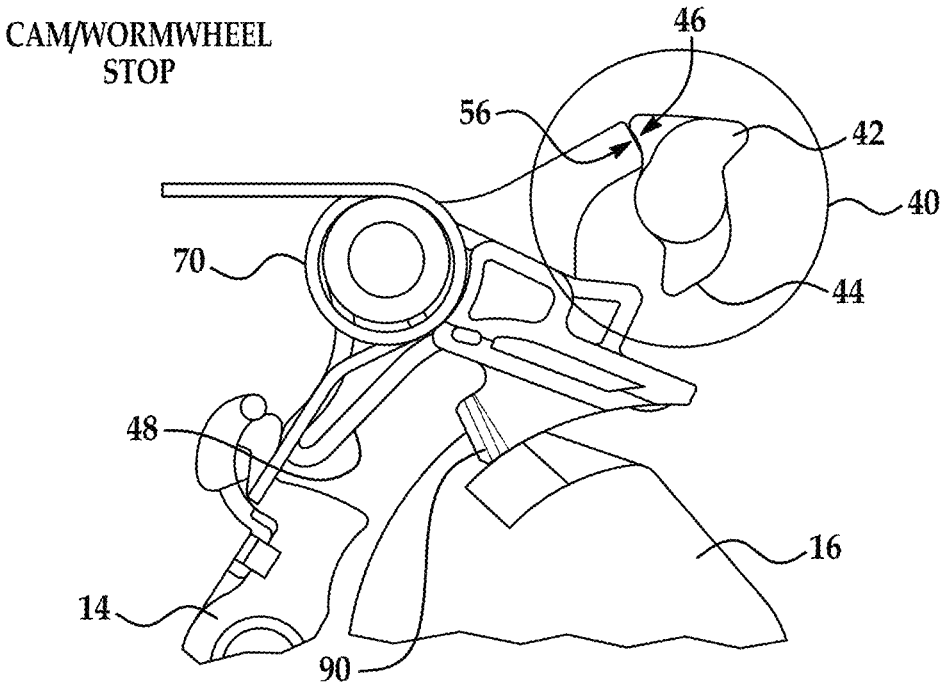
FIG. 7E illustrates the release mechanism in its stop position.

FIGS. 7A, 7B, 7C, 7D and 7E illustrate the positions of the release mechanism or actuator 50 in its rest (FIG. 7A), first contact (FIG. 7B), second contact (FIG. 7C), full travel (FIG. 7D) and stop positions (FIG. 7E). At first contact (FIG. 7B), the primary lobe 42 of the worm wheel 40 will make contact with the associated cam surface 52 of the release lever 48, creating a release torque in the direction of arrow 78 on the release lever 48. This geometry or configuration creates a maximum release torque 80 early in the travel to overcome static friction between the pawl/claw bite surface interface 82 thus optimizing the required energy.

Several degrees into the release event the primary lobe 42 of the worm wheel 40 reaches its maximum travel and the secondary lobe 44 (FIG. 7C) of the worm wheel 40 makes contact with the associated cam surface 54 of the release lever 48 to continue rotation to full release travel position (FIG. 7D). At full travel position, the pawl 14 will be clear of the claw 16 bite surface 84 and the stop feature 46 will make contact with the associated stop surface 56 of the release lever 48 (FIG. 7E) effectively stalling the gearset and halting the rotation of the release lever 48.

Figure 8:
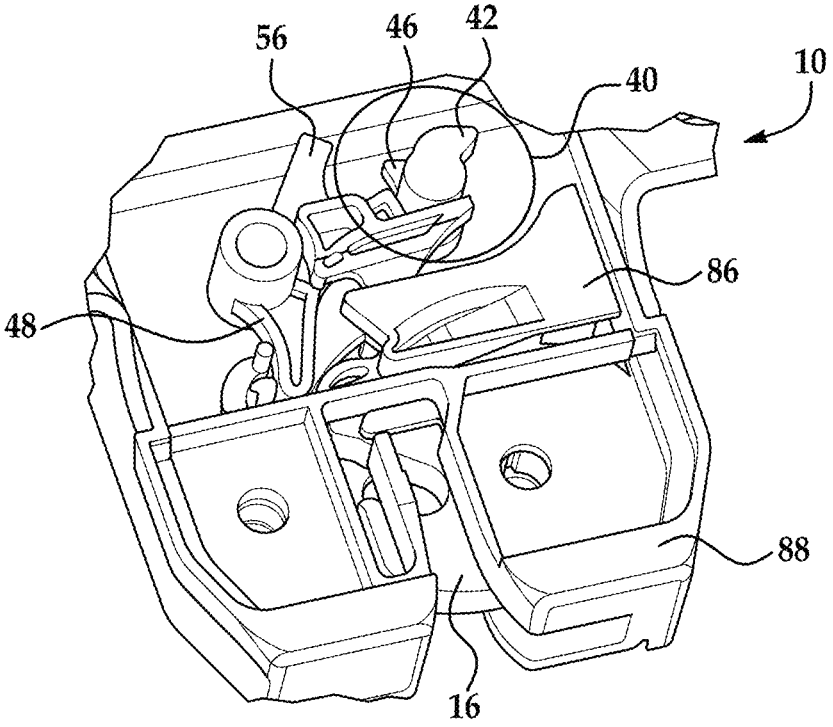
FIG. 8 illustrates a memory lever integrated into the latch housing.

The release lever 48 is held in the position of FIG. 7E by a lever or memory lever or hold open lever 86. FIG. 8 illustrates the memory lever 86 integrated into the latch housing 88. As the release lever 48 approaches the full travel position, an integral engagement feature 90 (FIG. 5) rotates into contact with the associated memory lever 86 feature integrated into the latch housing 88. In one embodiment, the memory lever, or hold open lever or lever 86 is formed of a resilient material such as plastic wherein a spring bias is provided such that as the lever 86 is deflected from a first position to a second position, upon application of a force, the lever 86 will return from the second position to the first position once the force is removed (e.g., spring bias returns the lever from the second position to the first position).

Figure 9:
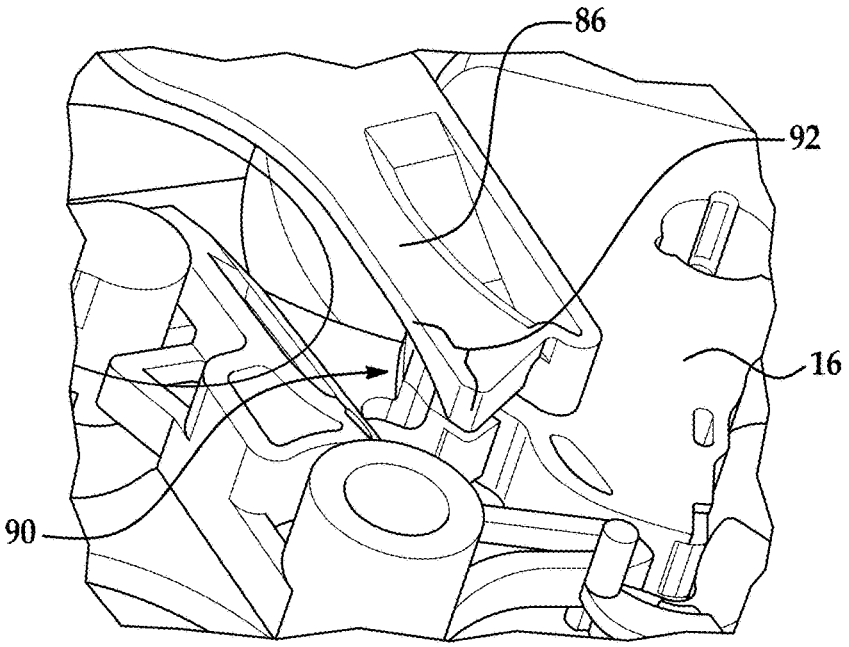
FIG. 9 illustrates a portion of the housing detailing a feature of the memory lever.
Figure 10:
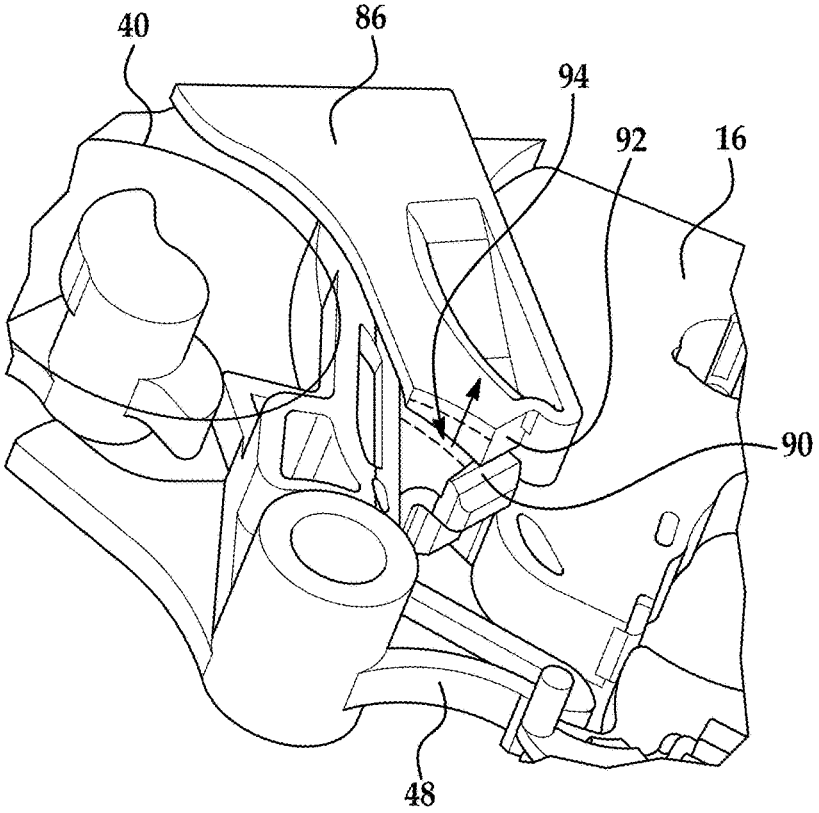
FIG. 10 illustrates the memory lever deflected up to its maximum position.

FIG. 9 illustrates a portion of the housing detailing the memory lever feature for clarity. The memory lever 86 has integral to it, a ramp feature 92 that will "ride up" the engagement feature 90 of the release lever 48, deflecting to its maximum position 94 as illustrated in FIG. 10.

Figure 11:
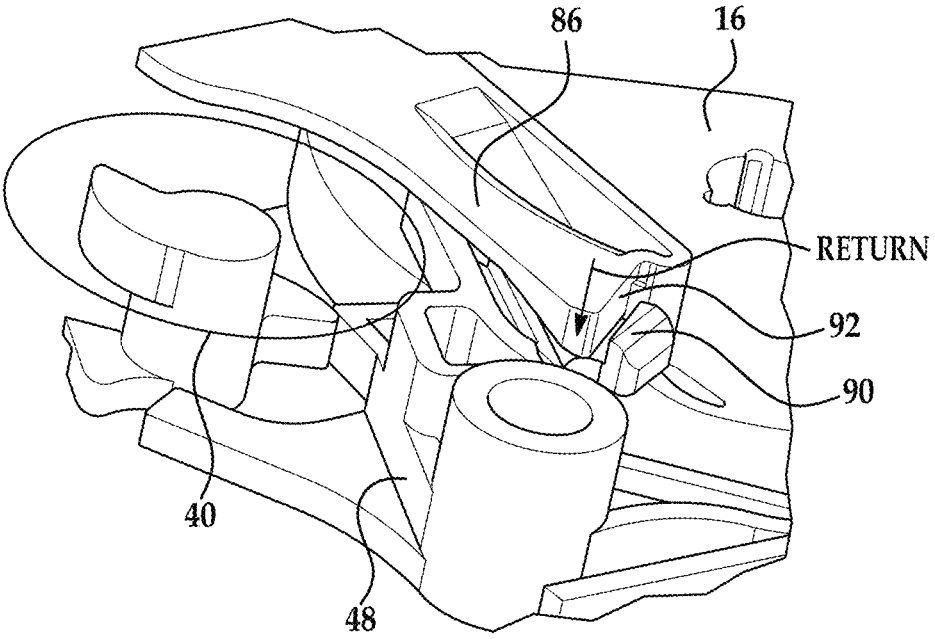
FIG. 11 illustrates the release lever in its maximum travel position and the memory lever in its un-deflected state.

Once the release lever 48 has passed by the point of maximum deflection, the memory lever 86 will return to its natural, un-deflected, position due to the elastic nature (e.g., plastic or otherwise) of the latch housing 88 material and the material lever 86 is formed from. This position is shown in FIG. 11. Once the release lever 48 has reached its maximum travel and the memory lever 86 has return to its un-deflected state, the release lever 48 will not be allowed to return it rest or original position due to the engagement feature 90 being held by the associated feature 92 of the memory lever 86.

Figure 12:
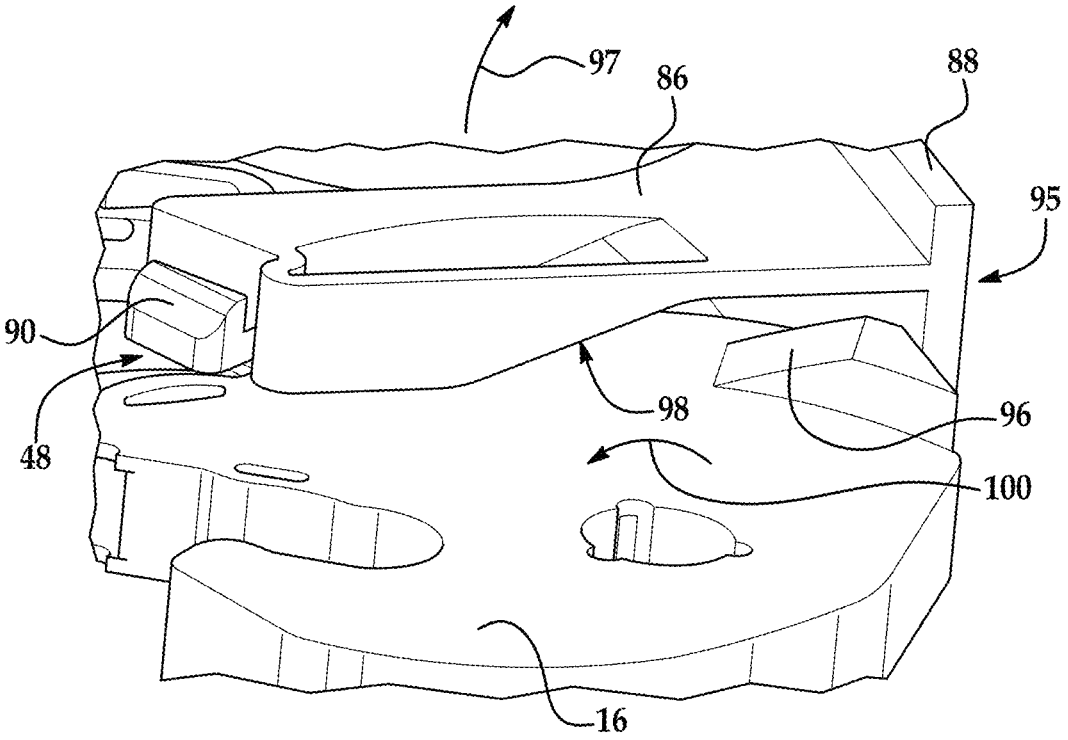
FIG. 12 illustrates a detail view of the memory lever, release lever, and claw overmold assembly.
Figure 13:
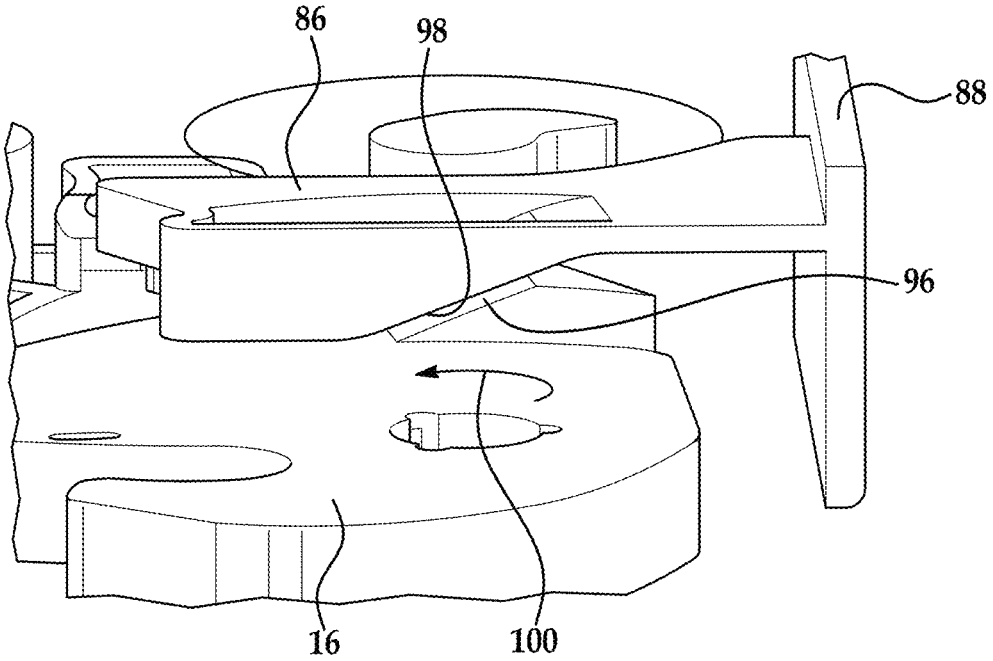
FIG. 13 illustrates the claw in an open position.
Figure 14:
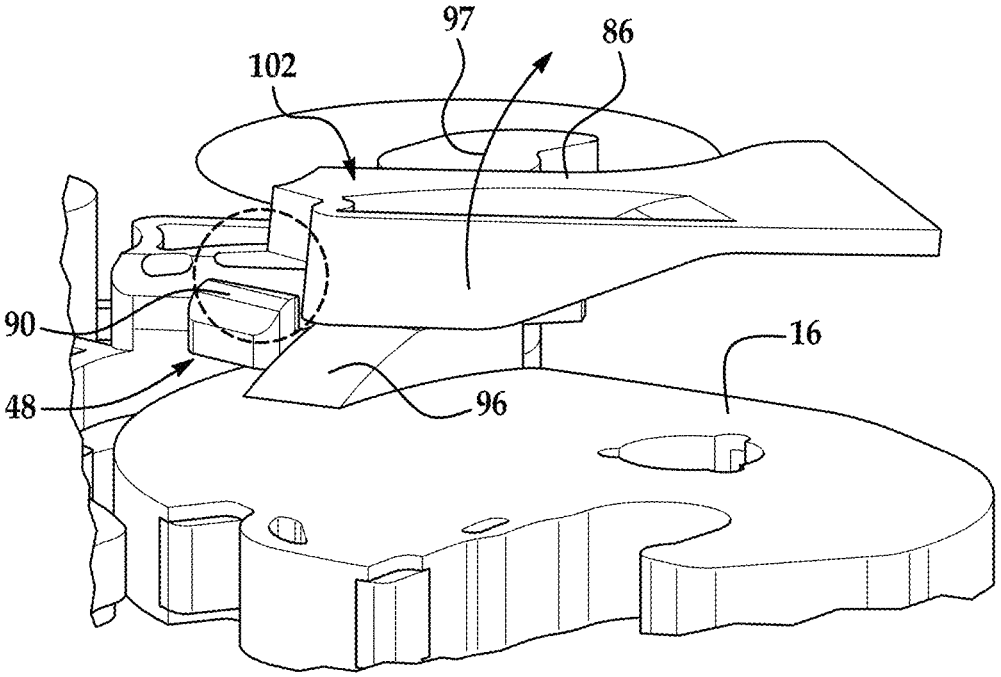
FIG. 14 illustrates the memory lever in its maximum deflected position.

FIG. 12 shows a detail view of the memory lever 86, release lever 48, and a claw overmold assembly 95 integrated into the overmold of the claw 16. The claw overmold assembly includes a ramp feature 96, which is configured to interface with an associated disengagement feature 98 integral to the memory lever 86 of the latch housing 88. Once the release lever 48 has reached its maximum travel position and the memory lever 86 is engaged with the associated engagement feature 90 of the release lever 48 as shown in at least FIG. 11, the claw 16 is then free to rotate to the open position in the direction of arrow 100. As the claw 16 rotates to the open position (FIG. 13), its integral ramp feature 96 contacts the associated disengagement feature 98 of the memory lever 86 causing it to displace it to its maximum deflected position 102 (FIG. 14). This occurs by deflecting the end of the lever 86 in the direction of arrow 97. Once in this position, the release lever 48 is then free to return to its neutral rest position by rotating about its axis in a counter clock wise direction as viewed in at least FIG. 7E. The release lever 48 is spring biased back into its neutral rest position (FIG. 7A) by the biasing force of spring 70, which contacts pawl 14 and pushes pawl 14 into the engaged position, which in turn pushes the release lever 48 into its neutral rest position (FIG. 7A).

This design is unique in that it reduces the spring torque required from the pawl return spring and significantly increases the crashworthiness of the product. Furthermore, reduced package size can be realized due to the smaller size of the components of the latch. Also, quality is enhanced by increasing release actuator sound performance.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A vehicle latch, comprising:

a frame;

a pawl rotatably mounted to the frame for movement between an engaged position and a disengaged position about a first axis;

a claw rotatably mounted to the frame for movement between a latched position and an open position about a second axis, wherein pawl is configured to impede rotational movement of the claw from the latched position to the open position when the pawl is in the engaged position;

a release lever rotatably mounted to the frame for movement about a third axis, the third axis being different from the first axis and the second axis, wherein the release lever includes a first cam surface, a second cam surface and a stop surface, the first cam surface, the second cam surface and the stop surface each being located in separate and distinct planes with respect to each other; and a worm wheel pivotally mounted to the frame, the worm wheel having a first cam lobe, a second cam lobe and a third cam lobe, wherein the first cam lobe, the second cam lobe and the third cam lobe are located in separate and distinct planes with respect to each other that correspond with the separate and distinct planes of the first cam surface, the second cam surface and the stop surface; and a motor assembly for rotating the worm wheel, wherein the release lever operably couples the pawl to the worm wheel, wherein, when the motor assembly operates the worm wheel, the first cam lobe and the second cam lobe interfere with the corresponding first cam surface and the second cam surface of the release lever, rotating the release lever to move the pawl from the engaged position into the disengaged position, allowing the claw to be moved toward the open position, and wherein further movement of the worm wheel will make the third cam lobe to interface with the stop surface, halting further rotation of the release lever.

2. The vehicle latch as in claim 1, wherein the first cam lobe and the second cam lobe act as driving surfaces to release the pawl from engagement with the claw.

3. The vehicle latch as in claim 1, wherein the release lever is spring biased into a rest position by a spring.

4. The vehicle latch as in claim 3, wherein the spring is located about a rotation axis of the release lever.

5. The vehicle latch as in claim 1, wherein a center of gravity (CG) of the pawl and a center of gravity (CG) of the release lever provide a system that is significantly more robust to external acceleration events than a latch with a pawl directly coupled to the worm wheel.

6. The vehicle latch as in claim 5, wherein the center of gravity (CG) of the pawl and the center of gravity (CG) of the release lever allow for a smaller return spring to be used with pawl.

7. A vehicle latch, comprising:

a frame;

a pawl rotatably mounted to the frame for movement between an engaged position and a disengaged position about a first axis;

a claw rotatably mounted to the frame for movement between a latched position and an open position about a second axis, wherein pawl is configured to impede rotational movement of the claw from the latched position to the open position when the pawl is in the engaged position;

a release lever rotatably mounted to the frame for movement about third axis, the third axis being different from the first axis and the second axis; and a worm wheel pivotally mounted to the frame, the worm wheel having a plurality of cam lobes, wherein each of the cam lobes are located in separate and distinct planes with respect to each other;

a motor assembly for rotating the worm wheel, wherein the release lever operably couples the pawl to the worm wheel such that rotational movement of the worm wheel rotates the pawl; and a memory lever integrated into a housing of the latch, the memory lever being formed of a resilient material such that a spring bias is provided to the memory lever when the memory lever is deflected from a first position to a second position, the memory lever being configured to restrain the movement of the release lever when the memory lever is in the first position.

8. The vehicle latch as in claim 7, wherein the memory lever has a feature configured to engage an integral engagement feature of the release lever.

9. The vehicle latch as in claim 7, wherein the memory lever has an integral ramp feature that slides up on an engagement feature of the release lever.

10. The vehicle latch as in claim 7, wherein the claw has an integral ramp that engages a ramp of the memory lever.

11. An actuator for a vehicle latch, comprising:

a motor assembly for rotating a worm wheel, the worm wheel having a plurality of cam lobes, wherein each of the cam lobes are located in separate and distinct planes with respect to each other;

a release lever rotatably mounted to a frame of the latch, wherein rotation of the worm wheel causes movement of the release lever; and a memory lever integrated into a housing of the latch, the memory lever being formed of a resilient material such that a spring bias is provided to the memory lever when the memory lever is deflected from a first position to a second position, the memory lever being configured to restrain movement of the release lever when the memory lever is in the first position.

12. The actuator as in claim 11, wherein two of the plurality of cam lobes act as driving surfaces to release a pawl from engagement with a claw of the latch.

13. The actuator as in claim 12, wherein one of the plurality of cam lobes is a stop feature that is configured to contact the release lever of the latch, wherein the release lever is operatively coupled to the pawl.

14. The actuator as in claim 11, wherein the memory lever has a feature configured to engage an integral engagement feature of the release lever.

15. A method of actuating a pawl of a vehicle latch, comprising:

pivotally mounting the pawl to a frame of the latch for movement about a first axis, the pawl being configured to prevent a claw of the latch from moving into an open position when the pawl is in an engaged position with respect to the claw;

pivotally mounting a release lever to the frame for movement about a second axis, the second axis being different from the first axis;

operably coupling the release lever to the pawl, wherein the release lever includes a first cam surface, a second cam surface and a stop surface, the first cam surface, the second cam surface and the stop surface each being located in separate and distinct planes with respect to each other;

operably coupling the release lever to a first cam lobe, a second cam lobe and a third cam lobe of a worm wheel pivotally mounted to the frame, the first cam lobe, the second cam lobe and the third cam lobe being located in separate and distinct planes with respect to each other that correspond with the separate and distinct planes of the first cam surface, the second cam surface and the stop surface; and rotating the worm wheel with a motor assembly, wherein when the motor assembly rotates the worm wheel, the first cam lobe and the second cam lobe interfere with the corresponding first cam surface and the second cam surface of the release lever, rotating the release lever to move the pawl from the engaged position into a disengaged position, allowing the claw to be moved toward the open position, and wherein further movement of the worm wheel will make the third cam lobe interface with the stop surface, halting further rotation of the release lever.

16. The method as in claim 15, wherein a center of gravity (CG) of the pawl and a center of gravity (CG) of the release lever provide a system that allows a torque of a pawl return spring to be lower than a torque required for a latch with a single pawl directly coupled to the worm wheel and the claw.

* * * * *